US006595690B2

(12) United States Patent
Machacek

(10) Patent No.: US 6,595,690 B2
(45) **Date of Patent: *Jul. 22, 2003**

(54) SHOCK RESISTANT TAMPER EVIDENT RECLOSABLE PLASTIC BAG

(75) Inventor: Zdenek Machacek, Nanuet, NY (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/969,736

(22) Filed: Oct. 3, 2001

(65) Prior Publication Data

US 2003/0064180 A1 Apr. 3, 2003

Related U.S. Application Data

(63) Continuation-in-part of application No. 09/695,176, filed on Oct. 24, 2000, now Pat. No. 6,354,738.

(51) Int. Cl.[7] ..... B65D 33/34

(52) U.S. Cl. ..... 383/203; 383/208; 383/61.2; 428/34.1; 428/35.2; 428/35.7

(58) Field of Search ..... 383/61.2, 203, 383/207, 208, 210, 210.1; 428/34.1, 35.2, 35.7

(56) References Cited

U.S. PATENT DOCUMENTS 6,273,607 B1 * 8/2001 Buchman ..... 383/5
6,354,738 B1 * 3/2002 Buckman et al. ..... 383/5

* cited by examiner

*Primary Examiner*—Harold Pyon
*Assistant Examiner*—Walter B Aughenbaugh
(74) *Attorney, Agent, or Firm*—Pitney, Hardin, Kipp & Szuch LLP

(57) ABSTRACT

A reclosable package is provided having a front wall and a rear wall joined at the bottom and sides and an open top containing a zipper. The zipper has a first profile and a second profile, each including interlocking members adapted to mate with each other. One profile has a flange secured to its associated wall at a location proximal a top end of that wall. The second profile has a flange portion secured to the other wall proximal a top end of that wall and to the first wall at a location below the location at which the first flange is secured to the first wall. A line of weakness extends along the second flange portion parallel to the profile interlocking member and between the two securing points. The line of weakness is formed in the cusp of a V-shaped section formed in the second flange and a peel seal is provided above the line of weakness joining together the sides of the V-shaped section.

3 Claims, 1 Drawing Sheet

SHOCK RESISTANT TAMPER EVIDENT RECLOSABLE PLASTIC BAG

This application is a continuation-in-part of U.S. patent application Ser. No. 09/695,176 entitled "Tamper Evident Reclosable Plastic Bag", filed Oct. 24, 2000, now U.S. Pat. No. 6,354,738.

BACKGROUND OF THE INVENTION

The present invention relates to reclosable plastic bags and in particular to such bags which are designed for use as primary packaging. Reclosable bags are finding ever growing acceptance as primary packaging, particularly, as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged. This may readily be accomplished by forming a plastic bag of a film having the appropriate barrier properties. However, where the bag is provided with a zipper, a problem arises in properly sealing the bag at the opening to be closed by the zipper, since the zipper itself does not provide a hermetic seal.

SUMMARY OF THE INVENTION

In U.S. Pat. No. 5,023,122 a plastic film sheet for use in forming a reclosable container is disclosed. The plastic film sheet includes profiles and a line of tear perforations which penetrate the film sheet. A frangible cap strip overlies the perforations providing an impervious seal which prevents the passage of air and moisture through the perforations. The strip is weaker than the film so that the film will tear along the perforations and the cap strip will separate along its length with the tearing of the film.

In co-pending application Ser. No. 09/695,176 filed Oct. 24, 2000 for TAMPER EVIDENT RECLOSABLE PLASTIC BAG, which is commonly assigned with the present application, there is disclosed making use of a strip having the above described, capped perforations, or another form of weakening, in a unique bag configuration. Accordingly, in accordance with the invention disclosed in the co-pending application a bag is provided having front and rear walls joined along the bottom and sides and open at the top. A zipper is provided at the bag top having a first profile and a second profile, the profiles including interlocking elements designed to interlock with each other. Each of the profiles includes at least one flange, the one flange extending from below the profile interlocking element toward the bag interior. The flanges are of unequal size with the shorter flange being sealed directly to one of the bag walls. The longer flange is sealed to the other bag wall and to the one bag wall below the point at which the shorter flange is sealed to the one bag wall. A line of weakening, such as the above described capped line of perforations is provided in the longer flange between the locations at which it is sealed to the two walls. The capped line of perforations or other form of a line of weakening is such as to weaken the profile flange, so that it may be readily ruptured, without detracting from the barrier property of the profile flange until rupturing actually occurs.

In practice, it has been noted that when such bags are filled and then dropped, the line of weakening tends to rupture due to the internal pressure exerted on the line of weakness by the contents of the bag. This may reduce the shelf-life for any product contained in the bag by breaking the barrier around the product and, in any event, gives the appearance of tampering. To enable the bag to better withstand such internal pressure, in accordance with the present invention the longer flange is formed into a V-sectioned shape, the line of weakness is provided in the cusp of the V-sectioned shape and a peel seal is provided above the line of weakness, joining the sides of the V-sectioned shape.

DETAILED DESCRIPTION OF THE PREFERRED EMBODIMENT

Figure 1:
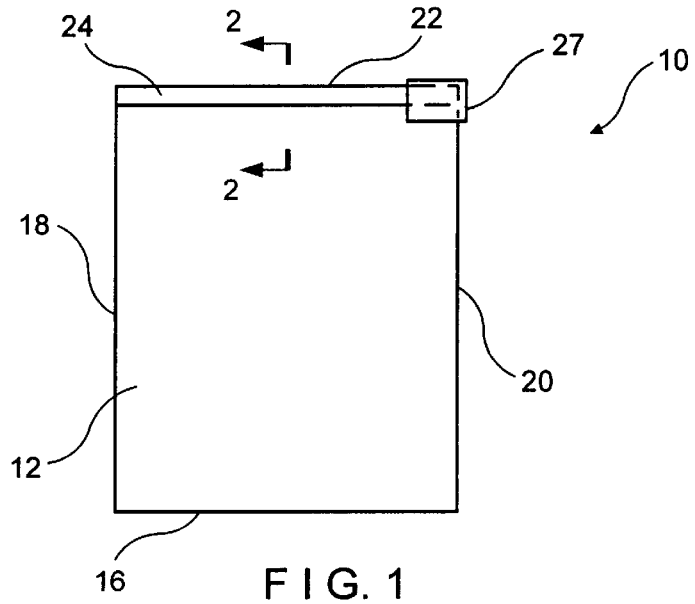
FIG. 1 is a front elevational view of a reclosable package in accordance with the present invention.

Reference is now made to the drawings and to FIG. 1 in particular wherein a package 10 in accordance with the present invention is depicted comprising front and rear walls 12, 14 joined at the bag bottom 16 and sides 18, 20. The bag top 22. is provided with a zipper 24 which, in turn may be provided with a slider 27 to facilitate opening and closing the zipper. The zipper 24 consists of profiles 26,28 having mating interlocking members 30,32 which interlock with each other in a conventional manner.

Each of profiles 26, 28 further includes a downwardly extending flange 34, 36. Flange 36 is secured to the bag rear wall 14 by a permanent seal 38 proximal the bag top. Flange 34, which is longer than flange 36, is secured to the bag front wall 12 by a permanent seal 40 proximal the bag top. Flange 34 is further secured by a permanent seal 42 to the bag rear wall 14 which is located below the seal 38. It should be appreciated that the seals 38, 40 and 42 extend from side 18 to side 20 thereby securing the zipper 24 to the bag 10 along the width of the bag.

The bag walls 12, 14 are formed of a suitable plastic film material for the product to be contained within the package 10. The flange 34 may similarly be formed of a laminate or coextrusion or monolayer extrusion comprising a barrier layer 44 contained within tie (or adhesive) layers 46 and sealant layers 48. In this manner flange 34 and the bag walls cooperate in maintaining a barrier completely around the product to permit the hermetic sealing of the product within package 10. In addition, one of the internal or external layers of flange 34 may comprise a high temperature material to facilitate controlling the sealing of the flange to the bag walls as required. The sealant layers 48 facilitate sealing the flange to the bag walls. The barrier layer may provide resistance to moisture and/or gases such as oxygen, carbon dioxide, nitrogen and other gases from entering (or exiting) the package and permits the package to be hermetically sealed if required. The hermetic sealing of the package contents is independent of the zipper and will be maintained whether the zipper is opened or closed as long as the bag walls and flange 34 remain intact.

A line of weakness 50 is provided in flange 34 extending along the flange parallel to interlocking member 32. The line of weakness may comprise a line of perforations 52 extending along the flange 34. To maintain the barrier of flange 34, the line of perforations is covered by a cap layer 54 in the manner described in the above mentioned U.S. Pat. No. 5,023,122. The cap layer having the required barrier properties and rendered frangible by a score line or appropriate grain orientation as described in the above referenced patent. Alternatively, the line of weakness 50 may consist of a score line 56 extending towards, but not through the barrier layer of the flange. In either case, the required barrier is maintained notwithstanding the line of weakness of the flange 34.

In operation, after the zipper is initially opened by a consumer, the flange 34 is presented before the consumer has access to the package contents. By bearing down on the flange 34 or simply separating the top ends of the bag, the line of weakness may be ruptured thereby providing access to the contents. The intact flange 34 provides evidence to the consumer that the package has not been tampered with prior to the consumer's rupturing of the weakened line.

Figure 2:
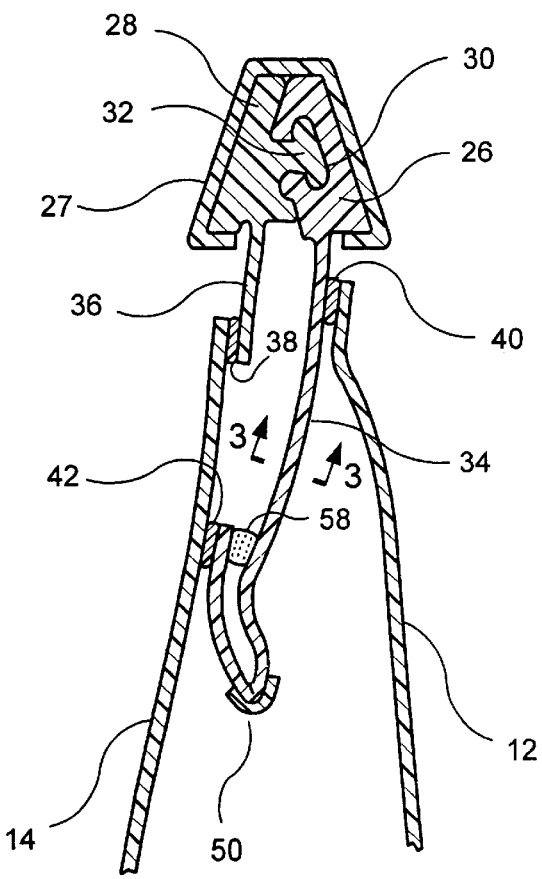
FIG. 2 is a fragmentary sectional view taken along reference line 2—2 of FIG. 1.
Figure 3:
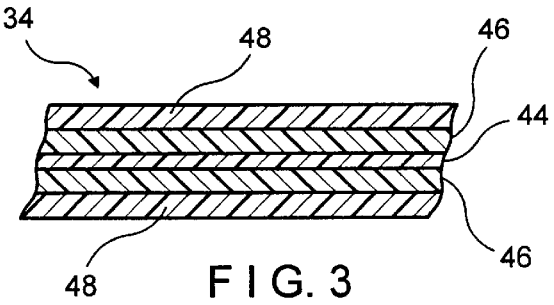
FIG. 3 is a fragmentary sectional view taken along reference line 3—3 of FIG. 2.
Figure 4:
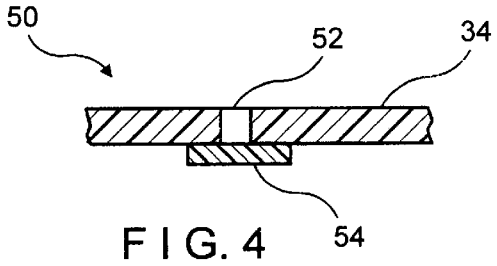
FIG. 4 is a fragmentary view depicting a first embodiment of a line of weakness extending along a profile flange.
Figure 5:
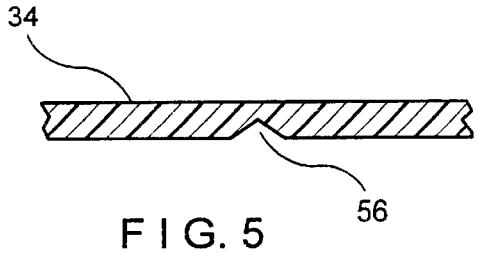
FIG. 5 is a fragmentary view depicting a second embodiment of a line of weakness extending along a profile flange.

To facilitate the consumer opening the package, the weakened line may be provided midway between the seal points 40, 42 of flange 34 or close to the seal point 42 to the bag walls. In this regard, flange 34 may be formed into a generally V-shaped section as shown in FIG. 2 with the line of weakness 50 in the cusp of the V. It has been noted that if the package is subjected to high internal pressure, such as would occur when the package is filled and accidentally dropped, the weakened line may inadvertently rupture. This may be alleviated to some extent by moving the weakened line toward the location of seal point 42 thereby providing a hinge effect enabling the weakened line to withstand a greater internal force. In addition, a peel seal 58 is provided joining the sides of the V-shaped section above the cusp of the V to keep the sides of the V together and hence enable both sides of the V-shaped section to move together to thereby take internal pressure off the line of weakness 50. The peel seal 58 is preferably aligned with the location of seal 42. The package may readily be initially opened by the consumer disengaging the zipper profiles and simply running a finger along the cusp of the V-shaped section of flange 34 to first rupture the peel seal 58 and then the line of weakness 50.

Thus it will be seen that the aforementioned objects have been attained. It should be appreciated that modifications can be made to the disclosed embodiments of the invention without departing from the scope of the invention as set forth in the following claims. For example, the zipper may be designed for slider-less operation in which case second, finger flanges may be provided on the profiles above the interlocking members.

Having thus described the invention, what is claimed is:

1. A reclosable package comprising:

a front wall and a rear wall;

a zipper having a first profile and a second profile, said profiles each including interlocking members mated with each other, said first profile including a first flange portion and said second profile including a second flange portion, said first flange portion being secured to one of said walls at a location proximal a top end of said wall and said second flange portion being secured to the other of said walls and to said one of said walls at a location below the location at which said first flange portion is secured to said one of said walls;

a line of weakness extending along said second flange portion parallel to said second profile interlocking member wherein said second flange portion forms a V-shaped section shaped between said walls and said line of weakness is substantially in the cusp of said V-shaped section; and a peel seal joining together the two sides of said V-shaped section above said line of weakness.

2. The reclosable package in accordance with claim 1 further comprising a slider disposed about said profile interlocking members, said slider engaging said interlocking members when moved in a first direction and to disengaging said interlocking members when moved in an opposite direction.

3. The reclosable package in accordance with claim 1 wherein said peel seal is substantially aligned with the location at which said second flange portion is secured to said one of said walls.

* * * * *